US012766662B2

(12) United States Patent
Yun

(10) Patent No.: US 12,766,662 B2
(45) Date of Patent: Oct. 20, 2026

(54) POLISHING APPARATUS WITH MICROWAVE DETECTION SENSOR

(71) Applicant: EBARA CORPORATION, Tokyo (JP)

(72) Inventor: Seungho Yun, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 286 days.

(21) Appl. No.: 18/358,811

(22) Filed: Jul. 25, 2023

(65) Prior Publication Data

US 2024/0157503 A1 May 16, 2024

(30) Foreign Application Priority Data

Aug. 1, 2022 (JP) ..... 2022-122539

(51) Int. Cl.
*B24B 37/015* (2012.01)
*B24B 49/10* (2006.01)
*B24B 49/14* (2006.01)

(52) U.S. Cl.
CPC ..... *B24B 37/015* (2013.01); *B24B 49/10* (2013.01); *B24B 49/14* (2013.01)

(58) Field of Classification Search
CPC ..... B24B 37/00; B24B 37/005; B24B 37/10; B24B 37/20; B24B 37/30; B24B 37/34; B24B 37/015; B24B 49/10; B24B 49/14; B24B 57/02
See application file for complete search history.

(56) References Cited

U.S. PATENT DOCUMENTS

2007/0243795 A1* 10/2007 Kobayashi ..... B24B 49/10 451/5
2013/0023186 A1* 1/2013 Motoshima ..... B24B 49/14 451/36
2016/0121452 A1* 5/2016 Takahashi ..... B24B 37/015 451/7
2017/0001281 A1 1/2017 Corsi et al.
2018/0111319 A1* 4/2018 Brezoczky ..... B29C 64/255

FOREIGN PATENT DOCUMENTS

| | | | |
|---|---|---|---|
| CN | 1637398 | A | 7/2005 |
| CN | 1813340 | A | 8/2006 |
| CN | 104416451 | A | 3/2015 |
| CN | 107924826 | A | 4/2018 |
| CN | 110948374 | A | 4/2020 |
| JP | 3034675 | B2 | 4/2000 |
| JP | 2006-284542 | A | 10/2006 |
| JP | 2008-503356 | A | 2/2008 |
| JP | 2013-022664 | A | 2/2013 |
| JP | 5827926 | B2 | 12/2015 |
| JP | 2016-087780 | A | 5/2016 |
| JP | 6410319 | B2 | 10/2018 |
| JP | 2020-110859 | A | 7/2020 |
| JP | 7021574 | B2 | 2/2022 |
| JP | 7041638 | B2 | 3/2022 |

* cited by examiner

*Primary Examiner* — C. A. Rivera
(74) *Attorney, Agent, or Firm* — BakerHostetler

(57) ABSTRACT

A polishing apparatus capable of measuring a surface temperature of a substrate while suppressing shielding by a polishing liquid is disclosed. The polishing apparatus includes a microwave detection sensor configured to generate microwave detection data by detecting microwaves, and a controller configured to determine the surface temperature of the substrate based on the microwave detection data.

3 Claims, 5 Drawing Sheets

POLISHING APPARATUS WITH MICROWAVE DETECTION SENSOR

CROSS REFERENCE TO RELATED APPLICATION

This document claims priority to Japanese Patent Application No. 2022-122539 filed Aug. 1, 2022, the entire contents of which are hereby incorporated by reference.

BACKGROUND

In a manufacturing process of semiconductor devices, a device surface planarization technology is becoming more and more important. Among these planarization techniques, the most important technique is chemical mechanical polishing (CMP). This chemical mechanical polishing (hereinafter which is referred to as CMP) uses a polishing apparatus to supply a polishing liquid (slurry) containing abrasive grains such as silica ($SiO_2$) and ceria ($CeO_2$) to a polishing pad. Polishing is performed by bringing a substrate such as a wafer into sliding contact with a polishing surface.

The CMP (Chemical Mechanical Polishing) apparatus is used in the process of polishing the surface of the substrate in the manufacture of the semiconductor devices. The CMP apparatus holds the substrate with a polishing head, rotates the substrate, and polishes the surface of the substrate by pressing the substrate against a polishing pad on a rotating polishing table. During polishing of the substrate, a polishing liquid (slurry) is supplied to the polishing pad, and the surface of the substrate is planarized by the chemical action of the polishing liquid and the mechanical action of abrasive grains contained in the polishing liquid.

The chemical action of the polishing liquid has temperature dependence according to the Arrhenius equation. The polishing rate of the substrate depends on a surface temperature of the substrate. Therefore, the surface temperature of the substrate is one of important factors in improving the accuracy of controlling the polishing rate. Therefore, a method of monitoring (measuring) the surface temperature of the substrate during polishing has been studied. As a method for monitoring the surface temperature of the substrate, it is preferable to use a non-contact type sensor that does not come into direct contact with the substrate from the viewpoint of avoiding abrasion of a detector while suppressing the influence on the surface of the substrate.

For example, in Japanese laid-open patent publication No. 2020-110859, the surface temperature of the substrate is measured by detecting infrared radiation emitted from the substrate with an infrared radiation thermometer. However, due to a wavelength range of the infrared radiation, the infrared radiation may not penetrate the polishing liquid and may be shielded. More specifically, if there is the polishing liquid on a detection path of the infrared radiation thermometer, the infrared radiation is shielded by the polishing liquid, making measurement difficult.

SUMMARY

Therefore, there is provided a polishing apparatus capable of measuring the surface temperature of the substrate while suppressing shielding by the polishing liquid.

Embodiments, which will be described below, relate to a polishing apparatus.

In an embodiment, there is provided a polishing apparatus comprising: a polishing table configured to rotatably support a polishing pad; a polishing head configured to rotatably hold a substrate and press the substrate against the polishing pad; a microwave detection sensor embedded in the polishing table and configured to generate microwave detection data by detecting microwaves; and a controller configured to determine a surface temperature of the substrate based on the microwave detection data.

In an embodiment, the controller is configured to: generate temperature distribution information indicating a temperature distribution of the substrate along a direction perpendicular to a surface of the substrate based on the microwave detection data; and determine a highest temperature among temperature distribution information as the surface temperature of the substrate.

In an embodiment, the controller is configured to: generate temperature distribution information indicating the temperature distribution of the substrate along a direction perpendicular to the surface of the substrate based on the microwave detection data; determine an average temperature of the temperature distribution as the surface temperature of the substrate.

In an embodiment, the controller is configured to: generate temperature distribution information indicating the temperature distribution of the substrate in a radial direction of the substrate based on the a plurality of microwave detection data along the radial direction of the substrate and a rotational speed of the polishing table and a rotational speed of the polishing head; and determine the temperature distribution in the radial direction of the substrate.

In an embodiment, the polishing apparatus comprises a pad temperature adjustment device configured to adjust a surface temperature of the polishing pad, and the controller is configured to operate the pad temperature adjustment device based on the determined surface temperature of the substrate to adjust the surface temperature of the polishing pad so that the surface temperature of the substrate reaches a target temperature.

In an embodiment, the microwave detection sensor comprises a CCD sensor configured to detect microwaves emitted from the substrate.

According to the polishing apparatus of the above-described embodiments, microwaves having a wavelength that can pass through the polishing liquid are used as a detection target, and by detecting the microwaves generated from the substrate, the surface temperature of the substrate can be measured while suppressing shielding by the polishing liquid.

DESCRIPTION OF EMBODIMENTS

Figure 1:
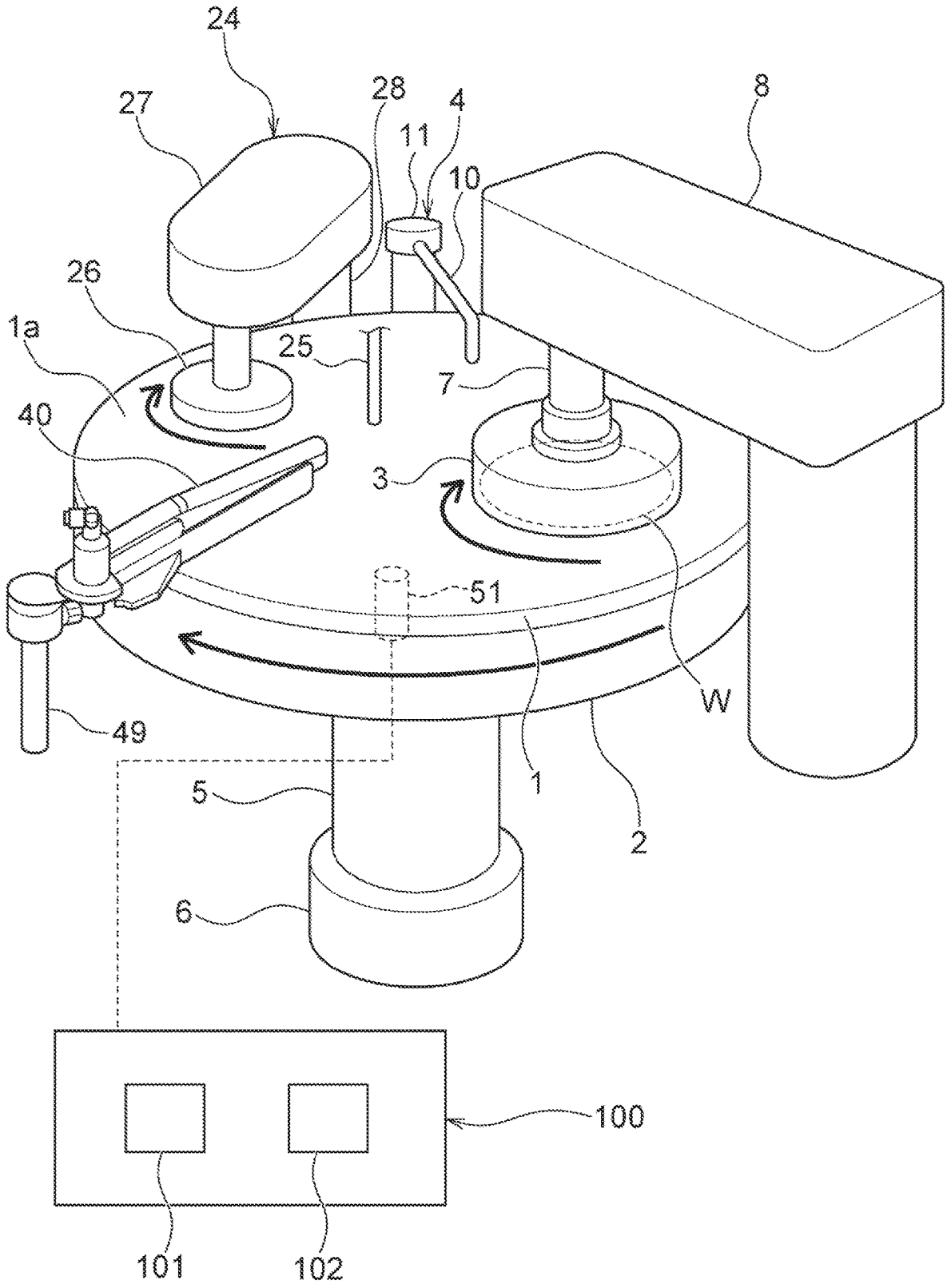
FIG. 1 is a perspective view of one embodiment of a polishing apparatus.

Hereinafter, embodiments will be described with reference to the drawings. In the drawings described below, the same or corresponding components are denoted by the same reference numerals, and redundant description is omitted.

FIG. 1 is a perspective view of one embodiment of a polishing apparatus. As shown in FIG. 1, the polishing apparatus (CMP apparatus) includes a polishing table 2 that supports a polishing pad 1, a polishing head 3 that presses a substrate W to be polished, such as a wafer, against the polishing pad 1, and a polishing liquid supply mechanism 4 for supplying a polishing liquid (slurry) onto the polishing pad 1.

The polishing table 2 is coupled to a table motor 6 disposed below a table shaft 5 via the table shaft 5, and is rotated in a direction shown an arrow by driving the table motor 6. The polishing pad 1 is attached to an upper surface of the polishing table 2, and the upper surface of the polishing pad 1 constitutes a polishing surface 1*a* for polishing the substrate W.

The polishing head 3 is fixed to a lower end of ahead shaft 7. The polishing head 3 is configured to hold the substrate W on its lower surface by vacuum suction. More specifically, the polishing head 3 holds a front surface (device surface) of the substrate W facing downward. A surface opposite to this front surface is a back surface of the substrate W, and the polishing head 3 holds the back surface of the substrate W by suction.

The head shaft 7 is coupled to a rotation mechanism (not shown) installed in ahead arm 8. The polishing head 3 is driven to rotate through the head shaft 7 by driving this rotation mechanism.

The polishing apparatus further includes a dressing device 24 for dressing the polishing pad 1. The dressing device 24 includes a dresser 26 that is in sliding contact with the polishing surface 1*a* of the polishing pad 1, a dresser arm 27 that supports the dresser 26, and a dresser pivot shaft 28 that rotates the dresser arm 27.

The dresser 26 swings on the polishing surface 1*a* as the dresser arm 27 swivels. A lower surface of the dresser 26 constitutes a dressing surface composed of a large number of abrasive grains such as diamond grains. The dresser 26 rotates while swinging on the polishing surface 1*a*, and dresses the polishing surface 1*a* by slightly scraping off the polishing pad 1. During dressing of the polishing pad 1, pure water is supplied from the pure water supply nozzle 25 onto the polishing surface 1*a* of the polishing pad 1.

The polishing apparatus further includes an atomizer 40 that sprays atomized cleaning fluid onto the polishing surface 1*a* of the polishing pad 1 to clean the polishing surface 1*a*. The cleaning fluid is a fluid containing at least a cleaning liquid (usually pure water). More specifically, the cleaning fluid is composed of a mixed fluid of a cleaning liquid and a gas (e.g., an inert gas such as nitrogen gas), or only the cleaning liquid.

The atomizer 40 extends along a radial direction of the polishing pad 1 (or polishing table 2), and is supported by a support shaft 49. This support shaft 49 is located outside the polishing table 2. The atomizer 40 is located above the polishing surface 1*a* of polishing pad 1. The atomizer 40 removes polishing debris and abrasive grains contained in the polishing liquid from the polishing surface 1*a* of the polishing pad 1 by jetting high-pressure cleaning fluid onto the polishing surface 1*a*.

The polishing liquid supply mechanism 4 includes a slurry supply nozzle 10 for supplying the polishing liquid onto the polishing pad 1, and a nozzle rotation shaft 11 to which the slurry supply nozzle 10 is fixed. The slurry supply nozzle 10 is configured to be able to swivel around a nozzle rotation shaft 11.

The substrate W is rotatably held by the polishing head 3. The polishing head 3 presses the substrate W against the polishing pad 1, and the polishing of the substrate W progresses by sliding between the polishing pad 1 and the substrate W. When polishing the substrate W, the polishing liquid (slurry) is supplied from the slurry supply nozzle 10 onto the polishing pad 1.

The polishing apparatus has a configuration for directly measuring a surface temperature (i.e., the temperature on the device surface side) of the substrate W without contacting the substrate W during polishing the substrate W. Hereinafter, such a configuration will be described with reference to the drawings.

Figure 2:
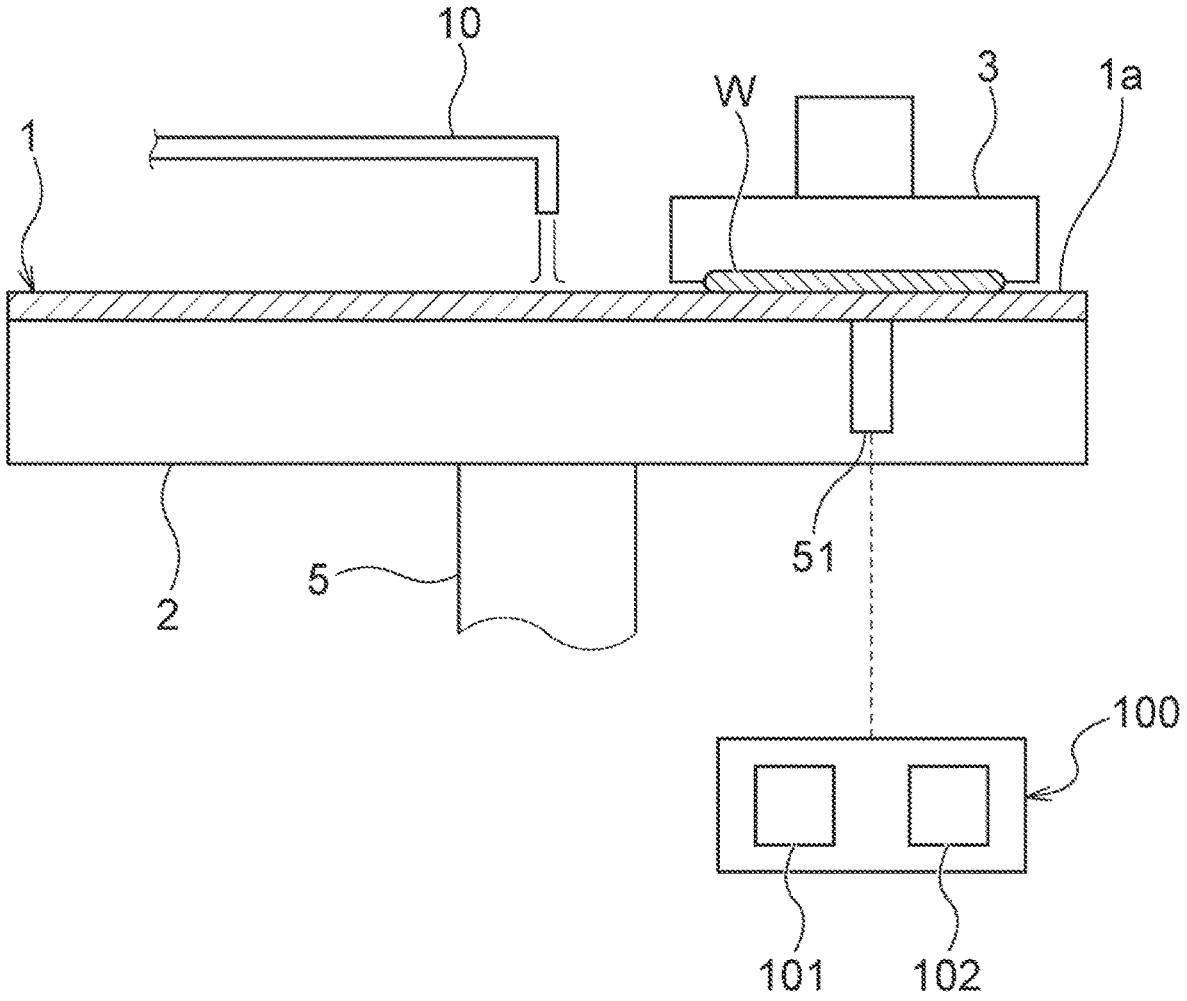
FIG. 2 is a cross sectional view of the polishing apparatus shown in FIG. 1.

FIG. 2 is a cross sectional view of the polishing apparatus shown in FIG. 1. In FIG. 2, illustrations other than main elements of the polishing apparatus are omitted. As shown in FIG. 2, the polishing apparatus includes a microwave detection sensor 51 embedded in the polishing table 2, and a controller 100 electrically connected to the microwave detection sensor 51.

The controller 100 is composed of at least one computer. The controller 100 is configured to determine the surface temperature of the substrate W based on microwave detection data sent from the microwave detection sensor 51. More specifically, the controller 100 includes an acquisition unit 101 that acquires the microwave detection data sent from the microwave detection sensor 51, and a conversion unit 102 that converts the microwave detection data acquired by the acquisition unit 101 to the surface temperature of substrate W.

The microwave detection sensor 51 is embedded in the polishing table 2. In the embodiment shown in FIGS. 1 and 2, the polishing apparatus includes a single microwave detection sensor 51, but may include a plurality of microwave detection sensors 51. In one embodiment, the microwave detection sensor 51 may include a polarizing plate (not shown) covering a detector of the microwave detection sensor 51. With such a configuration, it is possible to cut out unnecessary microwaves from unnecessary directions.

The microwave detection sensor 51 detects (receives) the microwaves (more specifically, intensity and frequency of the microwaves) emitted from the substrate W, generates the microwave detection data, and sends signals corresponding to the microwave detection data to the controller 100. Where, the microwaves mean electromagnetic waves having a frequency of 300 MHz to 300 GHz (wavelength of 1 m to 1 mm).

When the polishing table 2 rotates, the microwave detection sensor 51 embedded in the polishing table 2 rotates with the polishing table 2. When the microwave detection sensor 51 rotates around the polishing table 2, the microwave detection sensor 51 passes over the substrate W being polished, and detects the microwaves emitted from the substrate W.

The microwave detection sensor 51 receives the microwaves on the substrate W at an arbitrary detection cycle. For example, a short detection period may be determined so that a plurality of microwaves are detected on the surface of the substrate W during one rotation of the polishing table 2, or a long detection period may be determined so that one microwave is detected on the surface of the substrate W.

The microwave detection sensor 51 may be capable of switching the frequency and wavelength to be detected, or may be a CCD sensor capable of detecting microwaves emitted from the substrate W. Wavelength band may be a specific frequency or a wide range of wavelength bands.

The microwave detection sensor 51 embedded in the polishing table 2 is arranged directly under the polishing pad 1. Although the polishing pad 1 exists between the microwave detection sensor 51 and the substrate W, the microwaves emitted from the substrate W pass through the polishing pad 1 and reach the microwave detection sensor 51. At this time, a part of the microwaves is shielded, but the other part is received by the microwave detection sensor 51. Therefore, the microwave detection sensor 51 can detect the intensity and frequency of the microwaves emitted from the substrate W without installing a microwave transmitting material between the microwave detection sensor 51 and the substrate W.

Furthermore, the microwaves in a particular wavelength band are not affected by shielding by the polishing liquid. Therefore, the microwave detection sensor 51 can detect the intensity and frequency of the microwaves emitted from substrate W regardless of the presence or absence of the polishing liquid.

Figure 3:
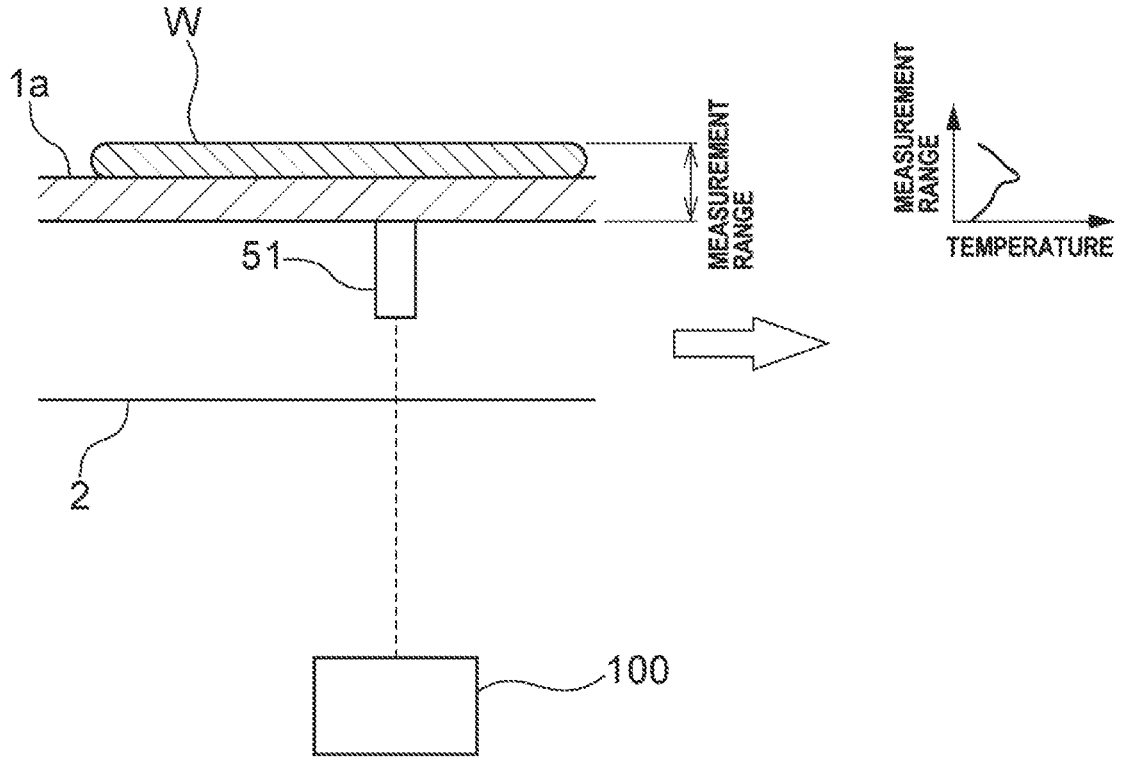
FIG. 3 is a view showing a temperature measurement range of the substrate by a controller.

FIG. 3 is a view showing a temperature measurement range of the substrate by the controller. As shown in FIG. 3, when the microwave detection sensor 51 and the substrate W are aligned in a straight line due to the rotation of the polishing table 2, the microwave detection sensor 51 detects the microwaves along a direction perpendicular to the surface of the substrate W. The controller 100 (more specifically, the acquisition unit 101) acquires temperature distribution information along the direction perpendicular to the surface of the substrate W based on the signal (i.e., microwave detection data) sent from the microwave detection sensor 51 (see graph in FIG. 3).

In the graph in FIG. 3, a horizontal axis shows the temperature and a vertical axis shows the microwave measurement range. The measurement range in FIG. 3 is a range between the microwave detection sensor 51 and the substrate W. The microwave measurement range includes the microwaves of the polishing pad 1 and the microwaves of the substrate W. Therefore, the microwave detection data includes not only the intensity and frequency of the microwaves emitted from the substrate W, but also the intensity and frequency of the microwaves emitted from the polishing pad 1.

Therefore, in this embodiment, the controller 100 (more specifically, the conversion unit 102) generates temperature distribution information indicating the temperature distribution along the direction perpendicular to the surface of the substrate W based on the microwave detection data included in the acquired distribution information. The controller 100 may determine a highest temperature in the temperature distribution information as the surface temperature of the substrate W. The controller 100 stores correlation data indicating a correlation between the microwave detection data and the surface temperature of the substrate in an interior of the controller 100 (e.g., in a memory section). Therefore, the conversion unit 102 derives the surface temperature of the substrate W based on the correlation data.

In one embodiment, the controller 100 may acquire the microwave detection data along the direction perpendicular to the surface of the substrate W, generate temperature distribution information along the direction perpendicular to the surface of the substrate W. and determine an average temperature of the generated temperature distribution as the surface temperature of the substrate W. In this embodiment, the controller 100 also derives the surface temperature of the substrate W based on the correlation data.

Figure 4:
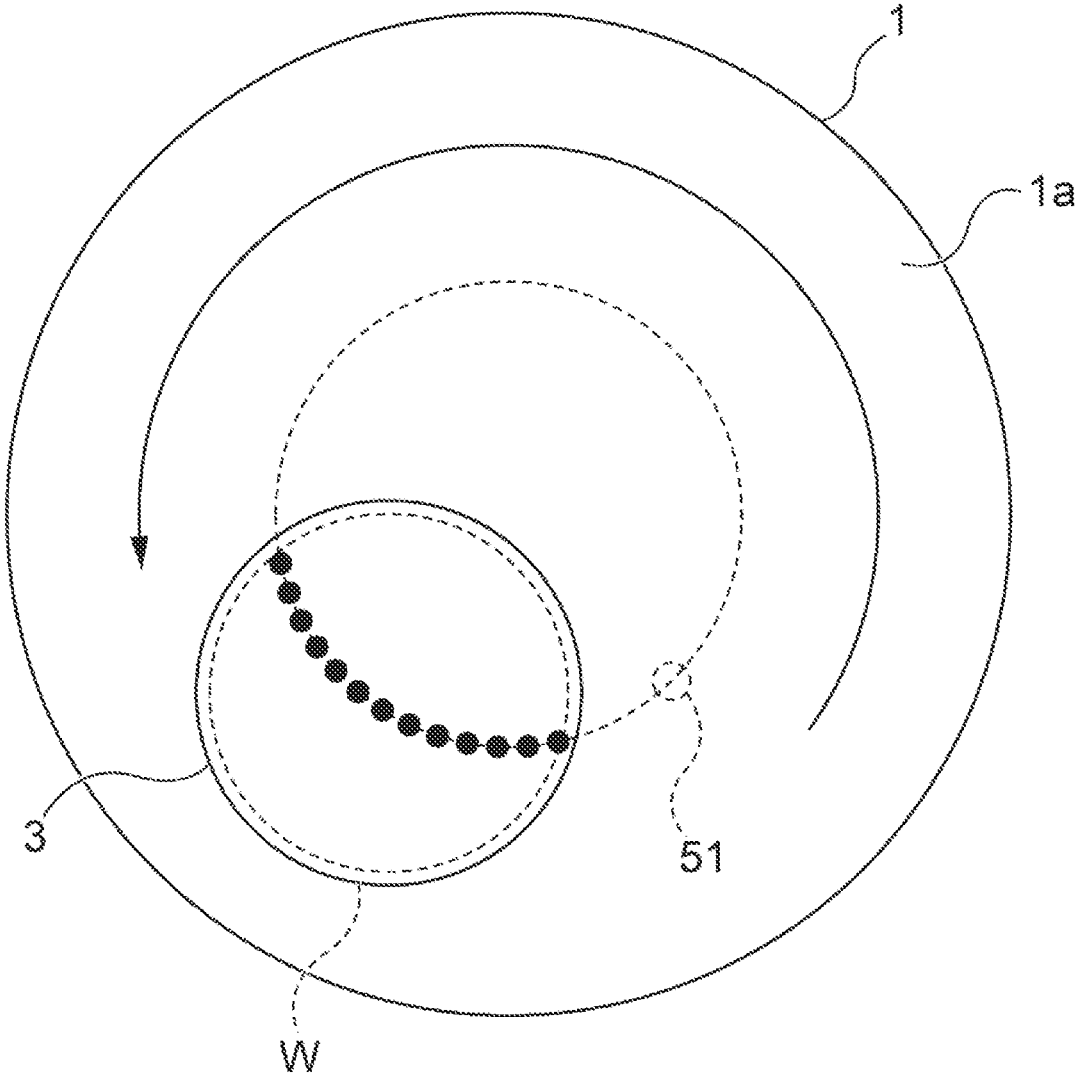
FIG. 4 is a view showing a rotation locus of a microwave detection sensor.

FIG. 4 is a view showing a rotation locus of the microwave detection sensor. As shown in FIG. 4, when the microwave detection sensor 51 rotates with the polishing table 2, the microwave detection sensor 51 forms the rotation locus passing through the substrate W (see dotted line in FIG. 4), and detects a plurality of microwaves along a radial direction of the substrate W. Preferably, the controller 100 operates the polishing table 2, the polishing head 3, and other components so that the microwave detection sensor 51 passes through a center of the substrate W.

The controller 100 acquires a plurality of temperature distribution information in the radial direction of the substrate W based on a plurality of microwave detection data along the radial direction of the substrate W (see black dots in FIG. 4) and a rotational speed of the polishing table 2 and a rotational speed of the polishing head 3.

In one embodiment, the polishing apparatus may include a rotational speed detector (e.g., rotary encoder) coupled to a rotational mechanism that detects the rotational speed of the polishing head 3. The controller 100 acquires the rotational speed of the polishing head 3 based on the rotational speed detector. Similarly, the controller 100 is electrically connected to the table motor 6, and acquires the rotational speed of the polishing table 2 based on signals sent from the table motor 6.

The controller 100 generates temperature distribution information indicating the temperature distribution in the radial direction of the substrate W based on the acquired distribution information, and determines the temperature distribution in the radial direction of the substrate W. In this embodiment, the microwave detection sensor 51 detects the microwaves at a plurality of detection points on the substrate W. Therefore, the controller 100 can generate a map of the surface temperature in the radial direction of the substrate W.

Figure 5A:
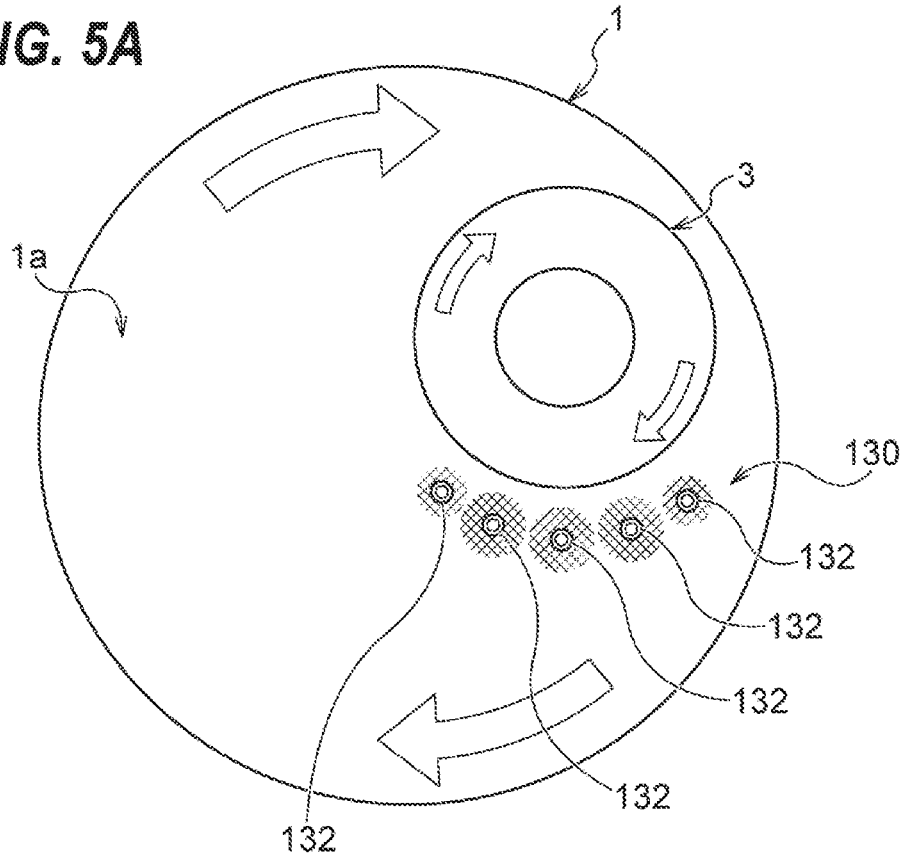
FIGS. 5A and 5B are views showing a temperature adjustment device.
Figure 5B:
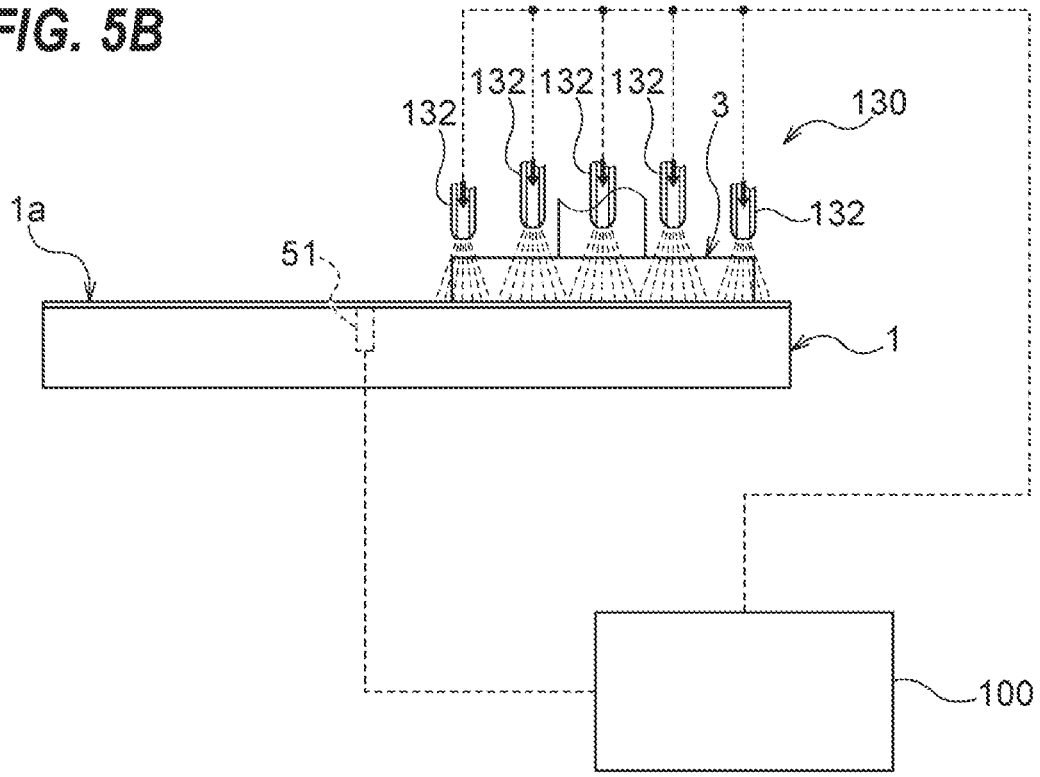

FIGS. 5A and 5B are views showing a temperature adjustment device. As shown in FIGS. 5A and 5B, the polishing apparatus includes a pad temperature adjustment device 130 that adjusts the surface temperature of the polishing pad 1. In this embodiment, the pad temperature adjustment device 130 includes a plurality of blowing nozzles 132 that blow a fluid (in this embodiment, gas) toward the polishing surface 1*a* of the polishing pad 1. These blowing nozzles 132 are adjacent to the polishing head 3, and are configured to blow the fluid at different positions on the polishing surface 1*a*.

Although not shown in the drawings, the pad temperature adjustment device 130 includes a gas supply source to which a gas such as pressurized gas or nitrogen gas is supplied, a pressure regulator that individually adjusts a flow rate of the gas blown out of each blowing nozzle 132, and a temperature adjustment device such as a heater or a cooler that individually adjusts the temperature of the gas blown out from each blowing nozzle 132. The pad temperature adjustment device 130 is electrically connected to the controller 100, and the controller 100 is configured to control operations of the pressure regulator and the temperature adjustment device.

The controller 100 operates the pad temperature adjustment device 130 to adjust the surface temperature of the polishing pad 1 based on the determined surface temperature of the substrate W, so that the surface temperature of the substrate W reaches the target temperature. The controller 100 can adjust the surface temperature of the substrate W by adjusting the surface temperature of the polishing pad 1.

In one embodiment, the controller 100 may feedback control the pad temperature adjustment device 130 while monitoring the determined temperature distribution in the radial direction of the substrate W. With this configuration, the controller 100 can control the surface temperature of the substrate W so that the temperature distribution in the radial direction of the substrate W is the desired temperature distribution.

In the embodiment shown in FIGS. 5A and 5B, the pad temperature adjustment device 130 is a non-contact type temperature adjustment device that adjusts the temperature of the polishing pad 1 without contacting the polishing pad 1. In one embodiment, the pad temperature adjustment device 130 may be a contact type temperature adjustment device that contacts the polishing pad 1 to adjust the temperature of the polishing pad 1.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table configured to rotatably support a polishing pad;

a polishing head configured to rotatably hold a substrate and press the substrate against the polishing pad;

a microwave detection sensor embedded in the polishing table and configured to generate microwave detection data by detecting microwaves derived from the substrate through the polishing pad; and a controller configured to:

generate temperature distribution information indicating a temperature distribution of the substrate along a direction perpendicular to a surface of the substrate based on the microwave detection data; and determine a highest temperature among the temperature distribution information as a surface temperature of the substrate.

2. The polishing apparatus according to claim 1, wherein the controller is configured to:

generate temperature distribution information indicating the temperature distribution of the substrate in a radial direction of the substrate based on the plurality of microwave detection data along the radial direction of the substrate and a rotational speed of the polishing table and a rotational speed of the polishing head; and determine the temperature distribution in the radial direction of the substrate.

3. The polishing apparatus according to claim 1, comprising a pad temperature adjustment device configured to adjust a surface temperature of the polishing pad, and wherein the controller is configured to operate the pad temperature adjustment device based on the determined surface temperature of the substrate to adjust the surface temperature of the polishing pad so that the surface temperature of the substrate reaches a target temperature.

* * * * *